United States Patent [19]

Neri

[11] Patent Number: 4,858,626

[45] Date of Patent: Aug. 22, 1989

[54] METHOD OF OPTIMIZING THE STANDARD WEIGHT VARIATION OF CIGARETTES ON A DUAL-ROD CIGARETTE MANUFACTURING MACHINE

[75] Inventor: Armando Neri, Bologna, Italy

[73] Assignee: G.D. Societa' Per Azioni, Bologna, Italy

[21] Appl. No.: 134,238

[22] Filed: Dec. 17, 1987

[30] Foreign Application Priority Data

Dec. 17, 1986 [IT] Italy ..... 3613 A/86

[51] Int. Cl.[4] ..... A24C 5/14

[52] U.S. Cl. ..... 131/84.4; 131/905; 131/906; 131/908

[58] Field of Search ..... 131/84.4, 906, 908, 131/905

[56] References Cited

U.S. PATENT DOCUMENTS

| | | | |
|---|---|---|---|
| 3,288,147 | 11/1966 | Molins et al. | 131/906 X |
| 3,515,860 | 6/1970 | Fitzgerald, Jr. | 364/300 |
| 3,648,035 | 3/1972 | Hart et al. | 131/905 X |
| 3,738,376 | 6/1973 | Labbe et al. | 131/84.4 |
| 4,196,740 | 4/1980 | Rudazinat | 131/84.4 X |
| 4,280,516 | 7/1981 | Reuland | 131/84.4 |
| 4,284,087 | 8/1981 | Reuland | 131/906 X |
| 4,336,812 | 6/1982 | Seragnoli | 131/84.4 X |
| 4,548,215 | 10/1985 | Adebahr | 131/84.4 |
| 4,600,020 | 7/1986 | Mattei et al. | 131/84.4 |

FOREIGN PATENT DOCUMENTS

| | | | |
|---|---|---|---|
| 2133965 | 8/1984 | United Kingdom | 131/84.4 |

*Primary Examiner*—V. Millin
*Assistant Examiner*—Joe H. Cheng
*Attorney, Agent, or Firm*—Marshall, O'Toole, Gerstein, Murray & Bicknell

[57] ABSTRACT

A method of optimizing the standard weight deviation of cigarettes on a machine having at least two manufacturing lines for producing continuous cigarette rods in which mean values and standard deviations are determined periodically relative to test measurements involving weighing a given number of cigarettes produced on a first line and an equal number of cigarettes produced on the second line with the standard deviations being compared to identify the test measurement having the highest standard deviation so that shavers on each line can be contolled such that the mean weight values of the two test measurements equal a given value selected as a function of the test measurement having the highest standard deviation.

3 Claims, 2 Drawing Sheets

FIG. 1
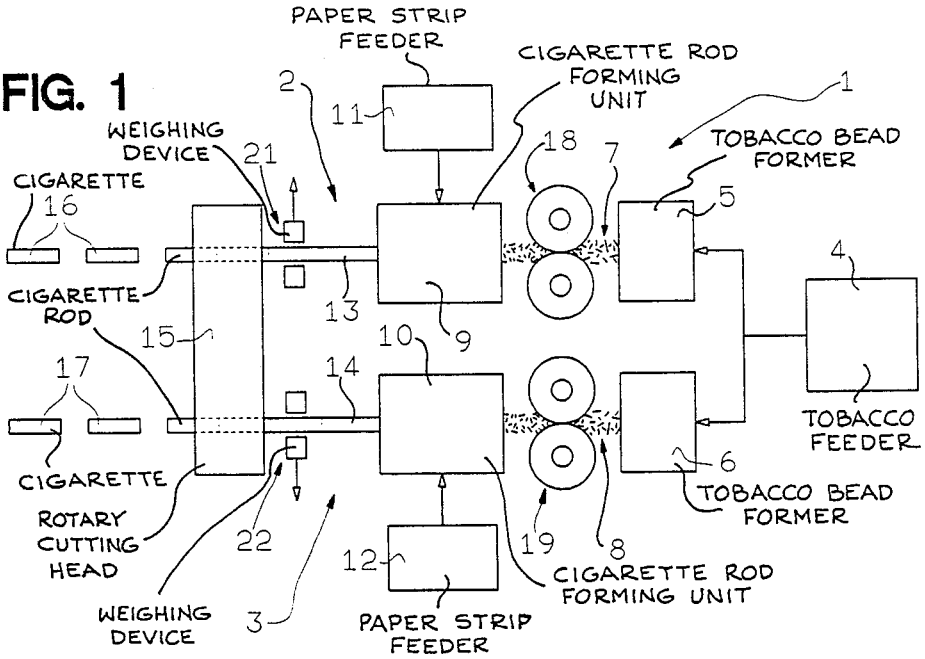
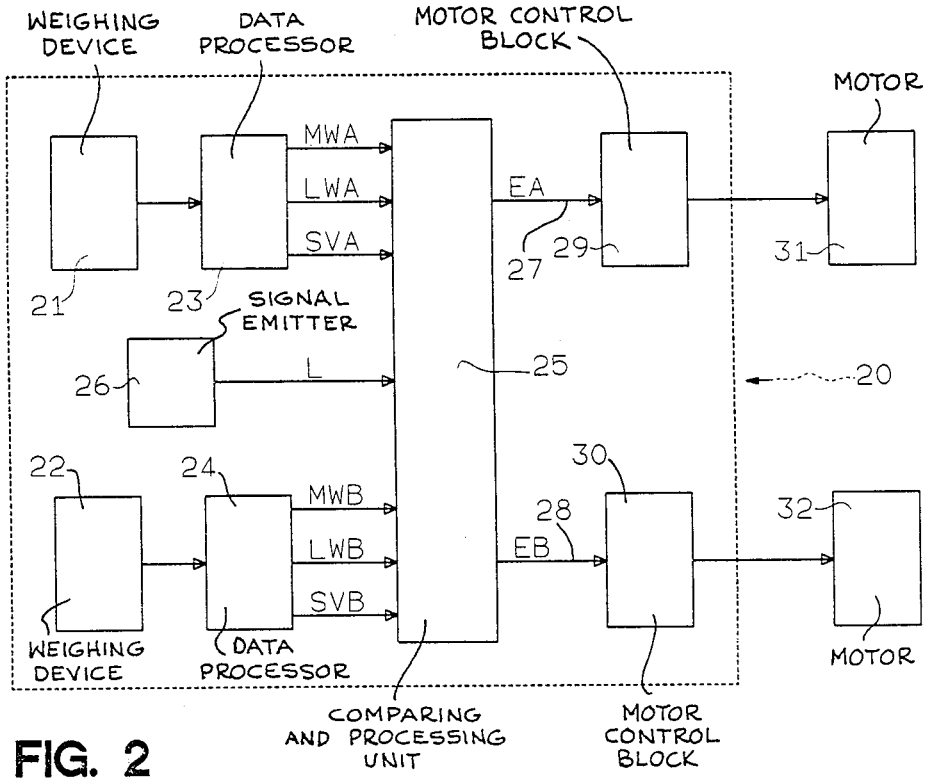
FIG. 2

METHOD OF OPTIMIZING THE STANDARD WEIGHT VARIATION OF CIGARETTES ON A DUAL-ROD CIGARETTE MANUFACTURING MACHINE

BACKGROUND OF THE INVENTION

The present invention relates to a method of optimising the standard weight deviation of cigarettes on a dual-rod cigarette manufacturing machine.

On modern single-rod cigarette manufacturing machines, cigarettes are formed starting with a batch of shredded tobacco carded inside a supply unit having an outlet in the form of a vertical duct.

In actual use, an upward stream of tobacco particles flows up the said duct and on to the underside of a suction type conveyor belt, so as to form a continuous layer or bead of tobacco, which is fed by the suction conveyor through a shaving station for evening off the thickness of the bead.

The bead is then fed into what is known as a filling station where it is gradually loaded by the suction conveyor on to a continuous strip of paper. The said paper strip and he continuous bead of tobacco placed on top of it are then fed through a forming beam, along which the opposite side edges of the strip are folded together about the tobacco bead and stuck together to produce a continuous cigarette rod, which is then cut into given cigarette lengths by a rotary cutting head.

One of the major requirements of cigarette manufacturing machines of the aforementioned type is that the weight of the cigarettes should be ad consistent as possible. For this purpose, cigarette manufacturing machines of the aforementioned type are known to include, not only a weighing device for rejecting cigarettes not conforming in weight with a given acceptance range, but also shavers connected to the said weighing device, for continuously and dynamically correcting the weight of the cigarettes, and ensuring it conforms as closely as possible with a given value within the said acceptance range.

In particular, the said shavers are known to be connected to a weighing and control unit designed to weigh each cigarette as it comes off the machine; to display the results, relative to groups of a given number of cigarettes, in the form of a Gaussian curve, usually showing the cigarette weight and number on Cartisian coordinate Y and X axes respectively; and to supply signals indicating the maximum, minimum and mean weight, and standard deviation or variance of the curve.

The standard variation is, of course, reflected in the size of the curve, and is an indication of the quality level being attained. That is to say, the tighter the curve, i.e. the lower the standard deviation of each curve, the more consistent is the cigarette weight within each sample group.

Maintaining the standard deviation below a given value within the acceptance range, however, is not the only concern of cigarette manufacturers. In addition to a good standard of quality, machines are also expected to provide for economy, which means maintaining the minimum weights on the curves as close as possible to the lower acceptance range limit.

For this purpose, the output signals from the said weighing and control unit are usually supplied to a processor for obtaining an error signal as a function of the difference between the minimum weight on the curve and the lower acceptance range limit, the said shavers being connected to the weighing device via the said processor, for maintaining the said error substantially equal to zero.

A dual-rod cigarette manufacturing machine is described, for example, in U.S. Pat. No. 4,336,812.

On machines of this sort, a single stream of tobacco particles is fed into an up-duct, in turn, supplying two parallel up-ducts, each terminating underneath a respective suction type conveyor belt. The beads formed on the belts are shaved by shavers and deposited on to continuous paper strips, which are wrapped about the beads to produce continuous cigarette rods, which are then cut into cigarette lengths by a single rotary cutting head.

On dual-rod cigarette manufacturing machines of the aforementioned type, cigarette weight may be controlled by connecting the shavers to a weighing and control unit, as on single-rod type machines.

The performance of such a system may be considered as being of the same standard as on a single-rod machine, if the cigarettes formed from each rod are judged separately, as though produced by two separate single-rod machines.

Quite the opposite applies, however, if the cigarettes from both rods are considered jointly, i.e. as being produced by the same dual-rod machine. In this case, the difference in weight between the cigarettes in each rod is far greater than on single-rod machines. In other words, dual-rod machines present a far higher standard weight deviations than single-rod machines.

The drawback of such a situation is that, downstream from the said cutting head, the cigarettes from both rods are processed jointly, i.e. are fed into the same filter assembly machine, and mixed together inside the finished packs.

SUMMARY OF THE INVENTION

The aim of the present invention is to overcome the aforementioned drawback.

With this aim in view, according to the present invention, there is provided a method of optimising the standard weight deviation of cigarettes on a cigarette manufacturing machine having at least two lines for producing respective continuous cigarette rods, each said line having shaving means for adjusting the amount of tobacco in the respective said rod; characterised by the fact that it comprises stages consisting in:

assigning each said line a device for weighing each individual cigarette;

determining simultaneously for each said line, the standard deviation and mean weight of a given number of cigarettes;

comparing the said standard deviations, for determining the measurement presenting the highest standard variation;

controlling the said shaving means on the said lines in such a manner that the mean weight of each said measurement equals a given value identical for all the said measurements and selected as a function of the said measurement presenting the highest standard deviation.

The above method preferably comprises further stages consisting in:

determining a lowest weight value for the said measurement presenting the highest standard deviation;

comparing the said lowest weight value with a given reference value, preferably the lower limit of an acceptance range within which the weight of the said cigarettes may vary; and controlling the said shaving means in such a manner that the said lowest weight value equals the said reference value, and the mean weight values of all the said measurements are equal.

BRIEF DESCRIPTION OF THE DRAWINGS

A non-limiting embodiment of the present invention will be described by way of example with reference to the accompanying drawings, in which:

FIG. 1 shows a schematic partial block diagram of a dual-rod cigarette manufacturing machine featuring the method according to the present invention;

FIG. 2 shows a block diagram of a cigarette weight control circuit according to the present invention and connected to the FIG. 1 machine;

DETAILED DESCRIPTION OF THE INVENTION

Figure 3:
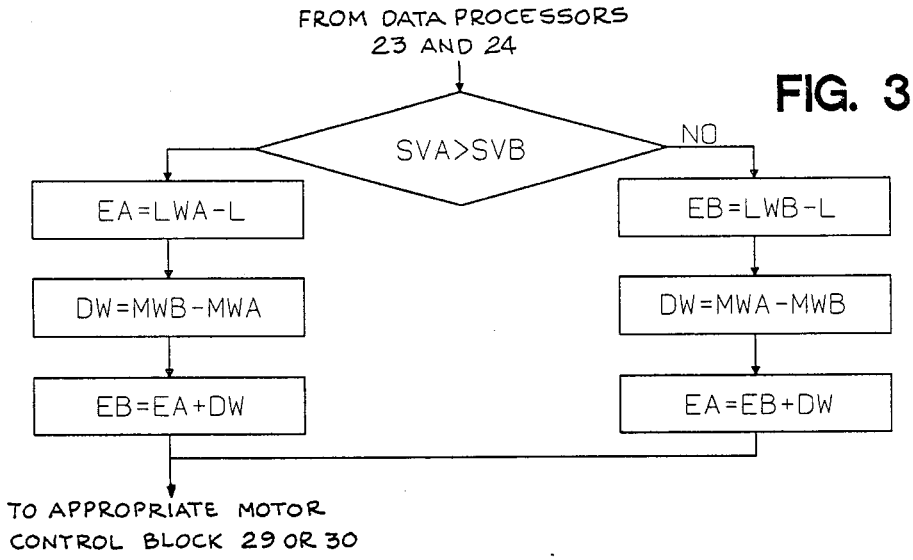
FIG. 3 shows a flow chart of a processing unit in FIG. 2.

In FIG. 1, a dual-rod cigarette manufacturing machine 1 is shown, for a detailed description of which reference should be made to U.S. Pat. No. 4,336,812 granted on June 29, 1982 to the assignee of the present invention, and which is incorporated herein by reference in the interest of full disclosure.

Number 1 in FIG. 1 indicates a dual-rod cigarette manufacturing machine comprising two side-by-side cigarette rod forming machine lines 2 and 3 supplied by a single shredded tobacco feeder 4. In particular, the said shredded tobacco is fed by feeder 4 to two tobacco bead formers 5 and 6 for forming respective tobacco beads 7 and 8.

The said lines 2 and 3 comprise respective cigarette rod forming units 9 and 10 designed to receive respective beads 7 and 8 and wrap the same inside respective paper strips (not shown) fed by respective paper strip feeders 11 and 12, for producing respective continuous cigarette rods 13 and 14. The said rods 13 and 14 are fed along respective lines 2 and 3 to a rotary cutting head 15 common to both lines 2 and 3 and designed to cut rods 13 and 14 into cigarette lengths 16 and 17 respectively.

As they travel between respective forming blocks 5 and 6 and respective forming units 9 and 10, the said beads 7 and 8 are subjected to respective shaving devices 18 and 19 designed to control the thickness of respective beads 7 and 8, and connected to a weighing and control unit indicated as a whole by 20 in FIG. 2.

As shown in FIG. 2, unit 20 comprises two known weighing devices 21 and 22, each comprising a radiation source and a radiation detector.

As shown in FIG. 1, the said devices 21 and 22 are located along respective lines 2 and 3, immediately upstream from cutting head 15, and are both designed to weigh successive rod portions later to be cut into individual cigarette lengths.

As shown in FIG. 2, the weights of each rod length are supplied by devices 21 and 22 to respective known data processors 23 and 24.

Figure 4:
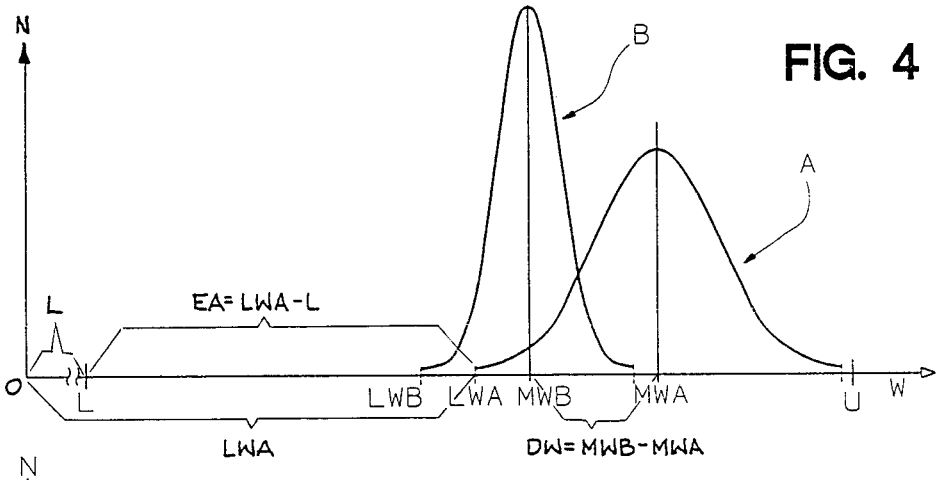
FIGS. 4 and 5 show graphs of weight variations detected in groups of cigarettes produced on the FIG. 1 machine.

The said processors 23 and 24 are designed to process the data received from respective devices 21 and 22 relative to the weights of a given number of cigarettes, and to display the results in the form of respective Gaussian curves A and B as shown in FIG. 4.

As shown in FIG. 4, the said curves A and B are plotted on a Cartesian coordinate showing the weights W of the said lengths of cigarettes on the X axis, and the number N of cigarettes on the Y axis.

As is usually the case, the weights of the cigarettes in FIG. 4 are all shown to be within a given acceptance range, the lower and upper limits of which are marked L and U respectively.

Processors 23 and 24 are also designed, in known manner, to supply output signals indicating the minimum and mean weights, and the variance or standard deviation of respective curves A and B.

Said values are indicated in FIGS. 2 and 3 as follows:

MWA=mean weight of curve A
LWA=lowest weight of curve A
SVA=standard deviation of curve A
MWB=mean weight of curve B
LWB=lowest weight of curve B
SVB=standard deviation of curve B
L=lower acceptance range limit As shown in FIG. 2, the outputs of processors 23 and 24 are connected to the inputs of a comparing and processing unit 25, together with the output of a signal emitter 26 for setting the value of L.

Figure 5:
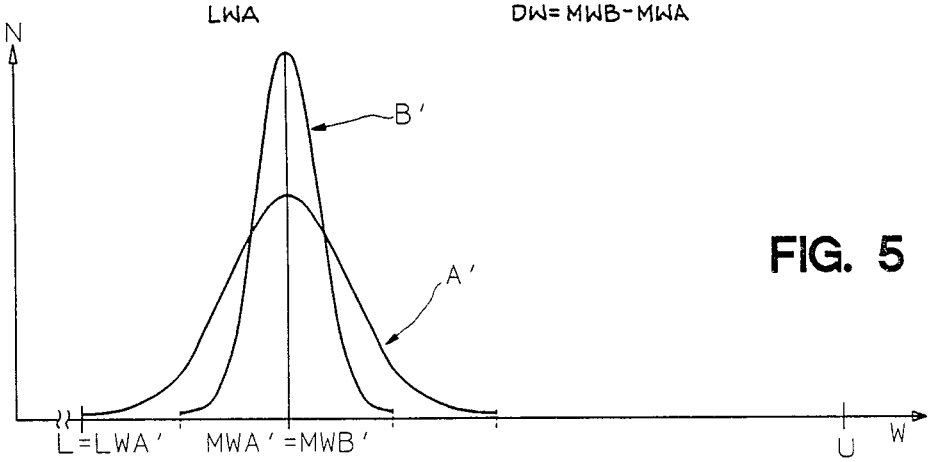

As shown in FIG. 3, the said unit 25 compares the SVA and SVB values continuously supplied by data processors 23 and 24 respectively. If, as in the example shown, SVA>SVB, unit 25:

subtracts L from LWA to given an error value EA;

subtracts MWA from MWB to give a value DW; and adds EA and DW to obtain a value EB. It follows, therefore, that:

EA=the amount by which curve A in FIG. 4 must shift for LWA to equal L, and curve A to match curve A' in FIG. 5; and EB=the amount by which curve B in FIG. 4 must shift for it to match curve B' in FIG. 5, with MWB'=MWA'.

As shown in FIG. 2, unit 25 presents two outputs 27 and 28 by which respective signals indicating values EA and EB are sent to respective motor control blocks 29 and 30 forming part of unit 20 together with unit 25. Blocks 29 and 30 control respective motors 31 and 32 connected to respective shaving devices 18 and 19 for moving them to and from respective beads 7 and 8, in such a manner as to cancel errors EA and EB.

In other words, therefore, unit 20 tends to maintain the weights of cigarettes 16 and 17 as shown graphically by curves A' and B' in FIG. 5, which show a maximum weight concentration about a mean value common to both curves, and as close as possible to lower limit L of the acceptance range.

The right-hand side of the FIG. 3 flow chart shows the logic sequence performed by unit 25 when SVB>SVA. No further explanation is required, over and above what has already been given in connection with SVA>SVB.

The method as described and illustrated above applies to a dual-rod cigarette manufacturing machine, for equalizing as far as possible the weights of the cigarettes produced jointly on the two lines 2 and 3, while at the same time maintaining cigarette weight as close as possible to the lower acceptance range limit.

For controlling machines with more than two lines, the method employed is, obviously, the same: that of determining which of the weight variation curves relative to the various lines presents the highest standard deviation; shifting this first curve so that its lowest weight equals the lower acceptance range limit; and shifting all the other curves so that their mean weights equal the mean value assumed by the said first curve once shifted.

I claim:

1. A method of optimizing the standard weight deviation of cigarettes on a cigarette manufacturing machine having at least two manufacturing lines for producing respective continuous cigarette rods, each said line having shaving means for adjusting the amount of tobacco in the respective rod characterized by stages comprising:

assigning each line (2, 3) a device for weighing each individual cigarette (16, 17);

simultaneously determining for each line (2, 3), the standard weight deviation and mean weight values of a given number of cigarettes (16, 17);

comparing the said standard weight deviations against each other to determine the measurement presenting the greatest standard weight deviation; and controlling the shaving means (18, 19) on the lines (2, 3) so that the mean weight value of each measurement equals a given value identical for all the measurements and is selected as a function of the measurement presenting the highest standard weight deviation.

2. A method according to claim 1 comprising:

determining a lowest weight value for the measurement presenting the greatest standard weight deviation;

comparing the lowest weight value with a given reference weight value;

controlling the shaving means (18, 19) so that the lowest weight value equals the reference weight value, and the mean weight values of all the measurements are equal.

3. A method according to claim 2 in which the reference weight value equals the lower limit of an acceptance weight range within which the weight of the cigarettes (16, 17) may vary.

* * * * *